United States Patent [19]

Vainer

[11] 3,947,731

[45] Mar. 30, 1976

[54] PIEZOELECTRIC LIGHTER

[75] Inventor: Ernesto A. Vainer, Buenos Aires, Argentina

[73] Assignee: Manufactura de Articulos para el Hogar "Aurora" Sociedad Anonima Industrial Comercial, Inmobiliaria y Financiera, Argentina

[22] Filed: Dec. 9, 1974

[21] Appl. No.: 530,603

[30] Foreign Application Priority Data

June 14, 1974 Argentina ..... 254216
June 17, 1974 Argentina ..... 254243

[52] U.S. Cl. ..... 317/81; 431/255
[51] Int. Cl.[2] ..... F23Q 2/28; F23Q 3/01
[58] Field of Search ..... 310/8.7; 431/255; 317/81, 317/DIG. 11

[56] References Cited

UNITED STATES PATENTS

| | | | |
|---|---|---|---|
| 3,271,624 | 9/1966 | Kingma et al. | 310/8.7 |
| 3,307,053 | 2/1967 | Furth | 431/255 X |
| 3,564,341 | 2/1971 | Nishiura | 431/255 |
| 3,576,471 | 4/1971 | Schumacher | 431/255 |
| 3,603,710 | 9/1971 | Riveron | 431/255 |

*Primary Examiner*—Kenneth W. Sprague
*Attorney, Agent, or Firm*—Allegretti, Newitt, Witcoff & McAndrews

[57] ABSTRACT

An improved actuation device for a piezoelectric lighter having an axially aligned hammer and a piezoelectric impact terminal. An elastic retention member engages the hammer as a bias force is imposed thereon. The actuation member is adapted to release the hammer by a displaceable actuation switch after the hammer passes through a predetermined distance thereby causing the hammer to strike the piezoelectric impact terminal.

4 Claims, 4 Drawing Figures

PIEZOELECTRIC LIGHTER

BACKGROUND OF THE INVENTION

The present invention relates to a piezoelectric lighter and particularly to an improved actuation device for piezoelectric lighters having a spark arrestor equipped with a tension unit as an accessory.

Known actuation devices include percussion mechanisms having operative means housed in metal casings that also form part of the lighter. These actuation devices contain, besides the ignition unit, a hammer mounted between a pair of springs that provide the striking force and return force for the hammer.

The hammer is positioned as a combined element in the metal casing. The casing has a latch operating a runway within the casing that responds to a displacement by releasing the load spring. In this type of combination, the latch responds to a torsion in the spring which carries the latch to its return position.

This type of mechanism is somewhat complicated and requires a carefully adjusted assembly in order to ensure its efficiency. At the same time, the mechanism is not sufficiently versatile to be used on any type and shape of lighter.

Likewise, the actuation mechanism cannot be used apart from the casing that houses the actuation mechanism since it requires an insulated cabinet.

On the other hand, ignition units are used in lighters, which utilize piezoelectric ceramics or crystals wherein deformation of the piezoelectric on returning or impact force can produce a sufficient potential difference to produce a spark between the electrodes associated therewith. These piezoelectric materials are shaped as cylindrical cartridges with at least one pair of the cartridges being housed axially within an adequate casing. One end of the casing is capable of receiving an impact to produce a deformation of both cartridges and produce a potential difference between its electrodes. The cartridges have their positive poles coinciding with the adjacent terminals, and their negative poles coinciding with the opposite terminals.

This arrangement requires accessory elements, such as a high tension conductor that, upon emerging from the intermediate contact point between both piezoelectric aligned elements, leads to the positive terminals of the lighter and a housing or conductor plate in contact with both opposite ends of the pair of cartridges and leads to the negative pole.

SUMMARY OF THE INVENTION

On the other hand, the present invention provides a more simple concept for actuating the ignition unit that eliminates the need for accessory connection elements and permits the manufacture of a single, insulated closed unit. This closed unit prevents the connection between opposite totally independent terminals and have connections between the positive and negative terminals respectively, between which the spark originates.

The extremely simplified form of the unit, permits it to have support means directly connected to the electrodes to absorb the repeated impacts.

An important advantage of the invention is the fact that the actuation mechanism, by eliminating the need for having a metal casing for its seat, can be directly mounted within the lighter body and is adequately insulated therefrom.

Furthermore, the actuation means of the present invention are directly combined with a push button, thus eliminating intermediate binding pieces and ensuring a higher efficiency and service life of the assembly.

Another advantage results from the versatility of the device, since it can be used in different forms in lighters and spark arresters, from the most sophisticated lighters in the form of pistols, to the most simple type of lighters such as those formed by a tubular housing.

The simplicity of the present invention makes assembly of the lighter extremely simple. Also, by maintaining the component springs independent, that is an independent return spring for the load hammer, offers additional safety in operation.

The other advantages and characteristics of the invention will be found in the specification. The several figures comprising part of this specification illustrate a preferred embodiment of the piezoelectric lighter of the present invention.

BRIEF DESCRIPTION OF THE DRAWINGS

In FIG. 1 the assembly is in its normal position, and shows the ignition unit in the shape of a cartridge, with its connections.

FIG. 2 shows the manner in which the solidary hammer in response to the displacement of the push button, is suddenly displaced to produce an impact on the projecting end of the impact plate of the ignition unit. The original position of the hammer is marked with a dot-dash line.

In the different figures the same reference numbers indicate equal or corresponding parts and the assembly of the several elements is marked with letters.

DETAILED DESCRIPTION OF THE DRAWINGS

Figure 1:
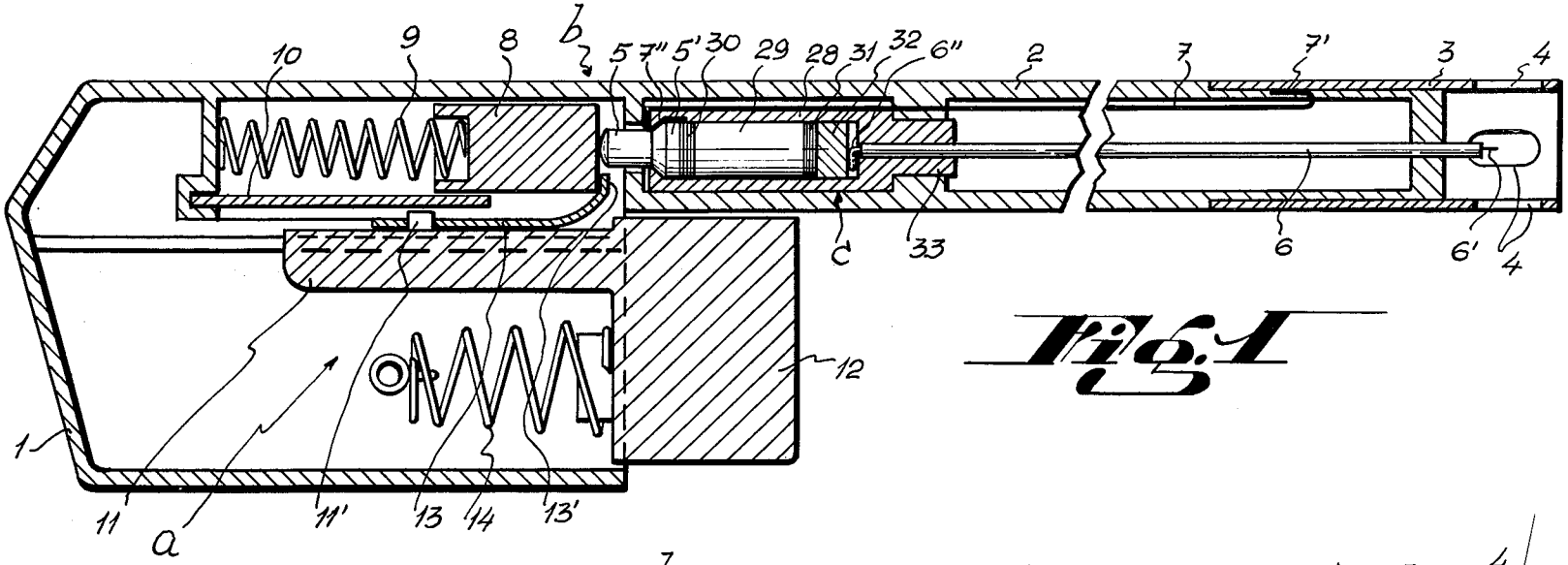
FIG. 1 is an elevated view of the actuation device of the present invention mounted on a piezoelectric lighter or spark arrester and represented in longitudinal section.
Figure 2:
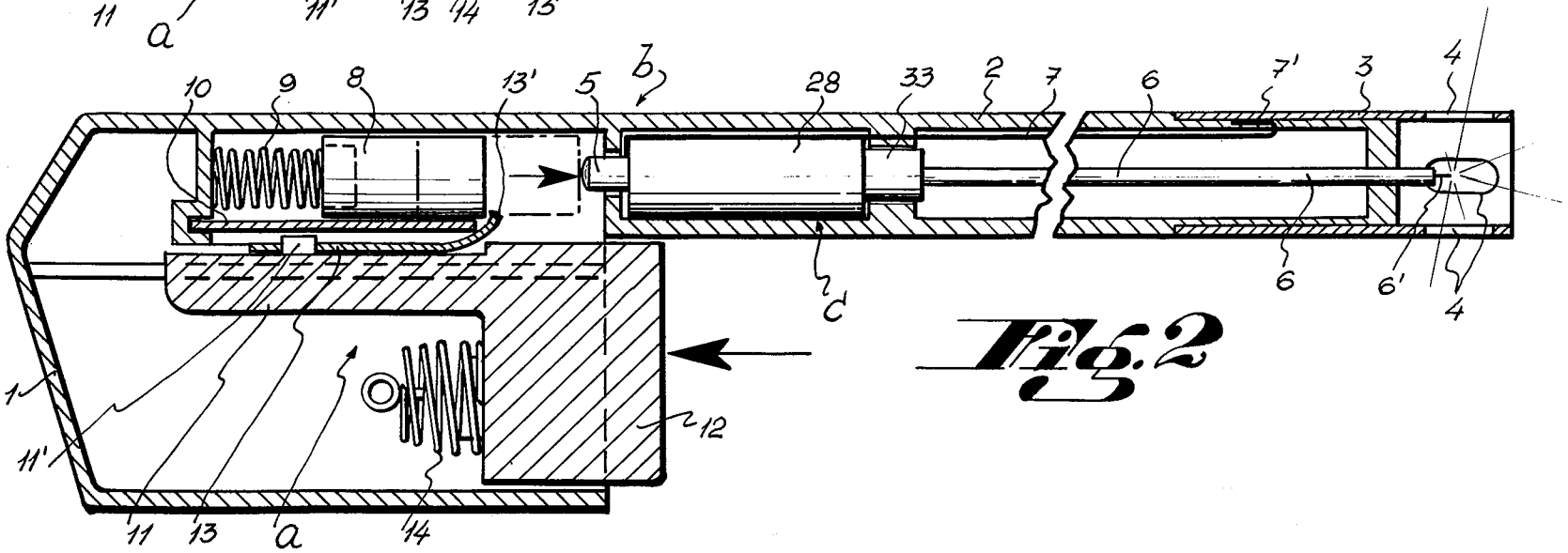
FIG. 2 is an elevated view of the device shown in FIG. 1, that shows the assembly in a loaded position. In particular.

In FIGS. 1 and 2, the piezoelectric lighter of the invention includes a mechanism *a* lodged in a housing or cover *b* that defines the lighter itself and which is formed by a pair of symmetrically placed members which abut against each other to form a rear body 1. Pipe 2 extends from body 1 and terminates in a tube or metal bushing 3. Pipe 2 ensures a firm union between the members which form body 1. The terminal end of tube 3 is supplied with holes 4.

The piezoelectric ignition unit *c* is housed in the rear portion or beginning of pipe 2 and is positioned with a rear impact projection 5 directed towards the butt end of body 1. Positive sheathed conductor 6 projects forward from unit *c* and has a bare terminal 6' placed adjacent to openings 4 of the end of tube 3. Metal tube 3 defines a negative electrode and is connected to the respective pole of the ignition unit *c* by means of a conductor 7 whose terminal 7' is doubled between the outer wall of pipe 2 and the metal tube 3 that surrounds pipe 2.

Hammer 8 is positioned within the upper rear portion of body 1 beneath cover *b* and is displaceably guided in a coaxial manner within pipe 2. An expansion spring 9 which constitutes part of mechanism *a* engages hammer 8.

The housing for hammer 8 and spring 9 has a fixed element 10 in its lower part, shorter than the housing seat, under which member 11 is displaceably guided and in cooperation with pulsator 12.

Member 11 is attached, by means of a hooking orifice in a lug 11' projecting from member 11, to a spring 13 with its forward portion 13' extending toward the seat of hammer 8.

The operation pulsator 12 cooperates with an expansion spring 14 that functions to return pulsator 12 to its original position.

As may be observed from the description and illustration, the operation of the device is very simple and effective. In the inoperative position of the device, as illustrated in FIG. 1, the bent terminal 13' of spring 13 is positioned to engage the end of hammer 8. When the pulsator 12 is pressed toward the interior of body *b* thereby overcoming the tension of return spring 14, member 11, which is preferably molded in an integral manner with pulsator 12, is displaced and carries with it spring 13. The bent terminal end 13' of spring *b* in turn pushes back hammer 8, thus charging the expansion spring 9 against hammer 8.

During displacement, the bent portion 13' of spring 13 contacts the forward edge of element 10 and elastically deforms portion 13' downward and hammer 8 is released as illustrated in FIG. 2. When hammer 8 is released it is suddenly driven by spring 9 and contacts or strikes the projecting terminal 5 of the ignition unit *c*, thereby energizing the piezoelectric element and producing sufficient electric voltage to provide a spark between the positive electrode 6' and the wall of the metal tube 3. As indicated, metal tube 3 is connected to the negative pole by conductor 7.

When the action on the pulsator 12 ceases, it returns through the force of spring 14 to its original position taking with it member 11 and spring 13. In this return movement the bent portion 13' of spring 13 returns to the initial retention position illustrated in FIG. 1.

Figure 3:
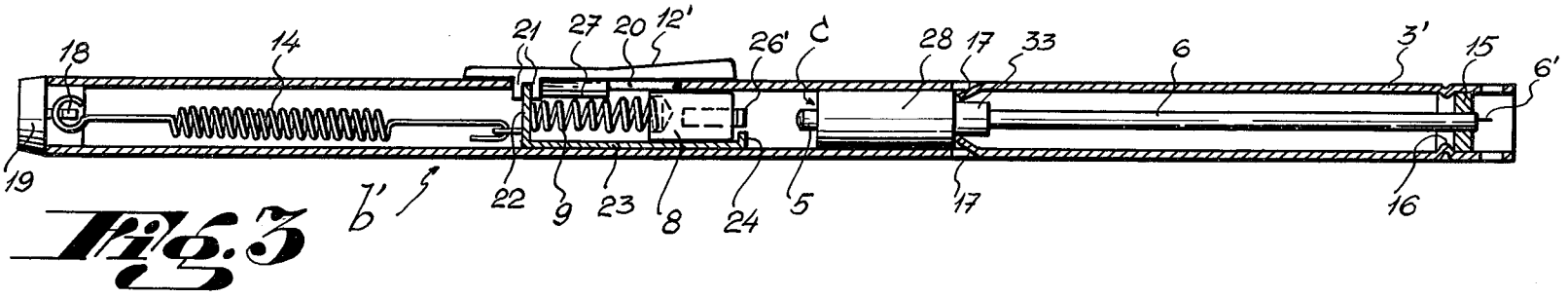
FIG. 3 is a side view of another embodiment of the present invention wherein the lighter or spark arrester is in a tubular configuration.
Figure 4:
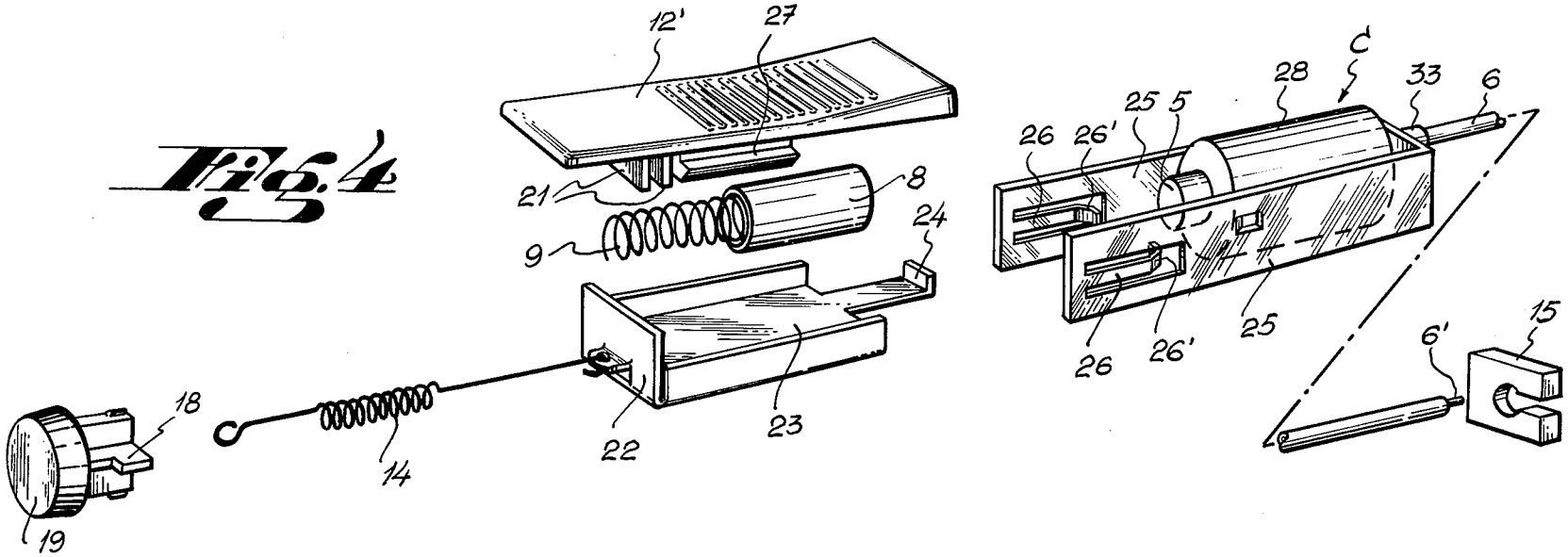
FIG. 4 is a perspective view showing the tubular lighter illustrated in FIG. 3 in a dismantled configuration.

In the embodiment illustrated in FIGS. 3 and 4, the mechanism *g* is positioned in a tubular hollow body *b* that has an open forward end 4' having positioned therein a positive electrode 6'. Electrode 6' is retained in position by an inner electrode holder 15 positioned on an annular rib 16 within the end of tube 3'. The ignition unit *c* is positioned against the internal projections 17 of tube 3' and has an impact projecting terminal 5 facing the hammer 8 (FIG. 3).

In this embodiment, the return spring 14 is fixed on one end to a projection 18 on rear plug 19 on the end of tubular body *b'*. A push-button 12' is positioned on the side surface.

Push button 12' has a pair of substantially parallel (preferably molded with the button) and transversally arranged projections 22 which pass through a groove 20 in the tubular body *b'*. Projections 22 project within the interior of body *b'* and contact sliding member 23 comprised of a hammer guide. The outside end of partition 22 engages the other end of return spring 14. The inside partition 22 engages the load spring 9 of hammer 8.

The sliding member or hammer guide 23 has a forward flange 24 that functions to restore hammer 8 to its initial position.

Parallel partitions 25 are positioned on the side of the ignition unit *c* ahead of and extend beyond the impact terminal 5. Hammer 8 is displaceable between partitions 25. A pair of elastic lugs 26 are formed in partitions 25. The ends 26' of partitions 25 are bent inward, i.e. converge. Lugs 26, with their inwardly projecting ends 26', constitute the retention means for hammer 8 during the loading of spring 9.

Button 12' extends through groove 20 of body *b'*. In addition, a pair of side portions 27, are positioned on both sides of the hammer 8 and comprise the release means for the hammer upon displacement of push-button 12' from the inoperative rest position illustrated in FIG. 3.

When the button 12' is displaced forward to overcome the tension return spring 14, the elements 21 of button 12' also draw the hammer guide member 23, the rear partition 22 of which compresses the load spring 9. Hammer 8 is retained in position by the bent ends 26' of the elastic lugs 26. In the displacement of members 23 the forward flange, which has a small height, passes below the impact terminal 5 of the ignition unit *c*.

When the side elements 27 of push-button 12' meet the bent ends 26' of lugs 26, lugs 26 elastically deform outward, that is to say, they open, thereby releasing the hammer 8. The tension in the loaded spring 9 impacts against the impact terminal 5 of the ignition unit *c*. The impact causes the necessary electric voltage to generate the spark between the positive electrode 6' and the wall of the tube 3'.

As may be observed, the embodiment illustrated in FIGS. 3 and 4, includes the basic concept of the invention as otherwise illustrated in FIGS. 1 and 2.

The ignition unit *c*, in FIG. 1, includes a hollow body 28 that houses the piezoelectric mass 29 which is positioned between two support disks 30 and 31. These disks are preferably made of metal and between which, in response to the impact, produces a difference in electric potential.

An impact piece 5' is positioned in front of disk 30, and is restrained by the end portions of a hollow body 28. Terminal 5 projects outward from impact piece 5 and is struck by hammer 8. Disk 30 is connected to the end 7'' of conductor 7 whose opposite end 7' establishes contact with the metal tube 3 and defines the negative electrode.

The other end of the ignition unit *c*, between the support disk 31 and the bottom of the hollow body 28, houses a metal support plate 32, against which the bent terminal 6'' of the conductor is positioned. The insulation sheath of the conductor 6 projects through bushing 33 formed in body 28 and has an uninsulated portion 6' facing the openings 4 of the metal pipe 3.

The metal mass of the support plate 32 absorbs the impacts produced on terminal 5 of the impact member 5', thus ensuring the perfect maintenance of the insulation body 28, that houses assembly *c*, without need for special metal casings for the impact member.

I claim as my invention:

1. A piezoelectric lighter which comprises:

a. a piezoelectric ignition unit having an impact terminal;

b. a displaceable actuation switch;

c. a first biasing means for providing a biasing force to return the actuation switch to its original position when displaced;

d. a movable hammer positioned to strike said impact terminal;

e. a second independent biasing means for providing a biasing force to displace said hammer;

f. said hammer, impact terminal and second biasing means being in axial alignment;

g. said hammer and second biasing means being positioned in a displaceable retention member adapted to be displaced by said actuation switch;

h. said hammer and actuation switch being detachably connected by an elastic retention member;

i. said elastic retention member comprises a lug adapted to engage said hammer and to displace the hammer against the second biasing means in response to the actuation switch; and j. means for releasing the elastic retention member when the hammer reaches a predetermined position thereby causing the hammer to strike the impact terminal.

2. A piezoelectric lighter as in claim 1 which includes a pair of spaced apart lugs, convergingly bent to engage said hammer and said releasing means comprises projection elements on said actuation switch positioned to engage said lugs and release said hammer when said hammer moves said predetermined distance.

3. A piezoelectric lighter which comprises:

a. a piezoelectric ignition unit having an impact terminal, said ignition unit being positioned within a hollow elongated housing, said unit further characterized in having piezoelectric material positioned between a pair of support disks, one of said disks being positioned against said impact terminal and adapted to provide a negative pole conductor, the other disk being positioned against a metallic absorption plate which is connected to a positive electrode;

b. a displaceable actuation switch;

c. a first biasing means for providing a biasing force to return the actuation switch to its original position when displaced;

d. a movable hammer positioned to strike said impact terminal;

e. a second independent biasing means for providing a biasing force to displace said hammer;

f. said hammer, impact terminal and second biasing means being in axial alignment;

g. said hammer and actuation switch being detachably connected by an elastic retention member;

h. said elastic retention member adapted to displace the hammer against the second biasing means in response to the actuation switch; and i. means for releasing the elastic retention member when the hammer reaches a predetermined position thereby causing the hammer to strike the impact terminal.

4. A piezoelectric lighter as in claim 3 wherein said hollow housing is formed from an insulating material having an opening at one end through which passes the impact terminal and the other end of the housing adapted to provide a seat for the absorption plate wherein the positive electrode is folded and placed between the plate and the housing end.

* * * * *